US006139348A

United States Patent [19]

Fukunaga

[11] Patent Number: 6,139,348

[45] Date of Patent: Oct. 31, 2000

[54] ELECTRIC CONNECTOR WITH AN ELASTICALLY DEFORMABLE CONTACT PIN

[75] Inventor: Masami Fukunaga, Kawaguchi, Japan

[73] Assignee: Enplas Corporation, Kawagushi, Japan

[21] Appl. No.: 09/068,406

[22] PCT Filed: Oct. 17, 1997

[86] PCT No.: PCT/JP97/03764

§ 371 Date: May 8, 1998

§ 102(e) Date: May 8, 1998

[30] Foreign Application Priority Data

Oct. 22, 1996 [JP] Japan ..... 8-298036

[51] Int. Cl.[7] ..... H01R 11/22

[52] U.S. Cl. ..... 439/266; 439/264

[58] Field of Search ..... 439/266, 264, 439/342

[56] References Cited

U.S. PATENT DOCUMENTS 5,002,499 3/1991 Matsuoka ..... 439/342

5,646,447 7/1997 Ramsey et al. ..... 257/727

FOREIGN PATENT DOCUMENTS 8-273779 10/1996 Japan .

*Primary Examiner*—Lincoln Donovan
*Assistant Examiner*—Javaid Nasri
*Attorney, Agent, or Firm*—Fish & Richardson P.C.

[57] ABSTRACT

An IC socket includes a contact pin having a plate-like shape. The IC package has a solder ball, and the side surface of the contact portion is separated from the side surface of the solder ball. The contact portion is thinned at its central portion as compared with the edge portions, and the inclined surfaces contact but are separate from the solder ball. Normal lines of the contact points of both the inclined surfaces are directed to the center of the solder ball. The solder ball is received in the thinned portion thereof. In this way, a location space is narrowed in comparison with a flat plate contact pin. The solder ball is also guided by a pair of inclined surfaces to locate it in the predetermined position, and form a wiping effect.

8 Claims, 11 Drawing Sheets

ELECTRIC CONNECTOR WITH AN ELASTICALLY DEFORMABLE CONTACT PIN

TECHNICAL FIELD

The present invention relates to a contact pin having an improved structure adapted to contact to and separate from a spherical terminal of an electronic part such as semiconductor, (called IC package hereinlater) and an improved electric connector using the contact pin.

BACKGROUND ART

As a conventional one of such contact pin, there is provided the contact pin, for example, shown in FIGS. 18 and 19 (see Japanese Utility Model Laid-open Publication No. SHO 60-109272). A contact 1 corresponding to such "contact pin" is formed of a sheet of metal plate by bending the same, and a pair of contact pieces 2 and 3 are formed to the contact 1. As shown in FIG. 19, a rod-like pin terminal 4 is inserted between both the contact pieces 2 and 3 and an electrical connection is established through the contact of the pin terminal 4 to the contact pieces 2 and 3.

In more detail, one 2 of the contact pieces is formed with a slit portion 2*a* and the other one 3 thereof is formed with a cut-stand portion 3*a*. The rod-like pin terminal 4 contacts respective corner portions 2*b* and 3*b* of these slit portion 2*a* and theut-stand portion 3*a* to thereby establish the electrical conduction therebetween.

However, in such conventional structure of the distance L is not made short so much.

Furthermore, when the positional relationship between the pin terminal 4 and the contact pieces 2 and 3 at a portion at which such contact 1 is arranged, a is shifted, the pin terminal 4 cannot contact exactly to the corner portions 2*b* and 3*b* of the contact pieces 2 and 3, which may result in the lowering of the electrical conduction performance.

Then, the present invention has an object to provide a contact pin and an electric connector having advantage in location space and ensuring the electrical conduction performance.

DISCLOSURE OF THE INVENTION

In order to achieve the above object, according to the present invention, there is provided a contact pin having a long plate shape in which a contacting portion formed to a front end portion thereof is contacted to and separated from side surfaces of a spherical terminal of an electric part through an elastical deformation of the contact pin, the contact pin being characterized in that the contacting portion has a central portion having a thickness less than that of both side edge portions in a width direction thereof, two inclining surfaces are formed to the contacting portion so as to be contacted to and separated from the spherical terminal, and tangential lines at contacting portions of both the inclining surfaces and the spherical terminal are directed to the center.

According to this structure, since the central portion of the contact pin is made less in thickness than that both the side edge portions thereof in the width direction and the inclining surfaces are formed, the spherical terminal is inserted into the thin thickness portion, so that a space is reduced in comparison with a flat shape contact pin. Furthermore, according to the provision of the inclining surfaces, the spherical terminal is guided therealong to precisely locate the spherical terminal to a predetermined position, and moreover, through the sliding motion of the spherical terminal along the inclining surfaces, the wiping effect can be achieved.

In a preferred embodiment, the inclining surface is formed only to the front end contacting portion.

According to this structure, in addition to the above effect, the sectional secondary moment can be made large by forming the inclining surface only to the contacting portion, thereby reducing the twisting and flexing functions, thus making large the contact pressure between the spherical terminal and the contact pin.

In a further preferred embodiment, the front end portion is formed so as to provide two-fork shape as branched pieces to which the inclining surfaces are formed respectively.

According to this structure, in addition to the above effects, the wiping effect can be further improved because the flexing force as well as twisting force is caused to the respective branched pieces.

In a further preferred embodiment, each of the branched pieces of the fork shaped portion has a root portion having a width narrower than that of a portion of the contacting portion side.

According to this structure, in addition to the above effects, the respective branched pieces are twisted largely by making narrow the width of the root portion, thereby further improving the wiping effect and it becomes effective in a case of small contact pressure between the contact pin and the spherical terminal.

In a further preferred embodiment, each of the branched pieces of the fork shaped portion has a width gradually reducing from a root portion towards a front end portion thereof and the inclining surface is formed from the root portion to the front end portion.

According to this structure, in addition to the above effects, the sectional secondary moment can be gradually changed by forming each of the branched pieces of the fork shaped portion to have a width gradually reducing from a root portion towards a front end portion thereof and forming the inclining surface from the root portion to the front end portion, so that the stress distribution at respective positions of the branched pieces can be made substantially equal and the concentration of the stress can be prevented.

In another aspect of the present invention, there is provided an electric connector in which a contact pin having a long plate shape is disposed on a connector body, a movable plate adapted to elastically deform the contact pin when horizontally moved is disposed to be horizontally movable, an upper operation member is disposed on an upper portion of the connector body to be vertically movable, when the upper operation member is lowered, the movable plate is horizontally moved through a link mechanism to thereby elastically deform the contact pin and then displace the same and a spherical terminal of an electric part is thereby inserted under non-pressure contact condition to the contact pin, and when the upper operation member is moved upward, the movable plate is returned to an original position and the elastical deformation of the contact pin is then released, thereby contacting the front end contacting portion of the contact pin to the side surface of the spherical terminal of the electric part to establish an electrical connection, the contact device being characterized in that said contacting portion has a central portion having a thickness less than that of both side edge portions in a width direction thereof and contact pin is formed so as to provide two-fork shape having branched pieces, to which inclining surfaces are formed respectively so that tangential lines at contact points to the spherical terminal are directed to the center.

According to this structure, since the central portion of the contact pin is made less in thickness than that both the side edge portions thereof in the width direction thereof and the inclining surfaces are formed, the spherical terminal is inserted into the thin thickness portion, so that a space is reduced in comparison with a flat shape contact pin. Furthermore, according to the provision of a pair of inclining surfaces, the spherical terminal can be guided to thereby locate it to the predetermined position, and through the sliding motion of the spherical terminal along the inclining surfaces, the wiping effect can be achieved. Furthermore, by forming the contact pin so as to provide two-fork shape, since the twisting and flexing functions are caused to the respective branched pieces thereof, the wiping effect can be further improved.

BEST MODE FOR EMBODYING THE INVENTION

The exemplary embodiments of the present invention will be described hereunder.

[Exemplary Embodiment 1]

FIGS. 1 to 13 represent a first exemplary embodiment 1.

Figure 4:
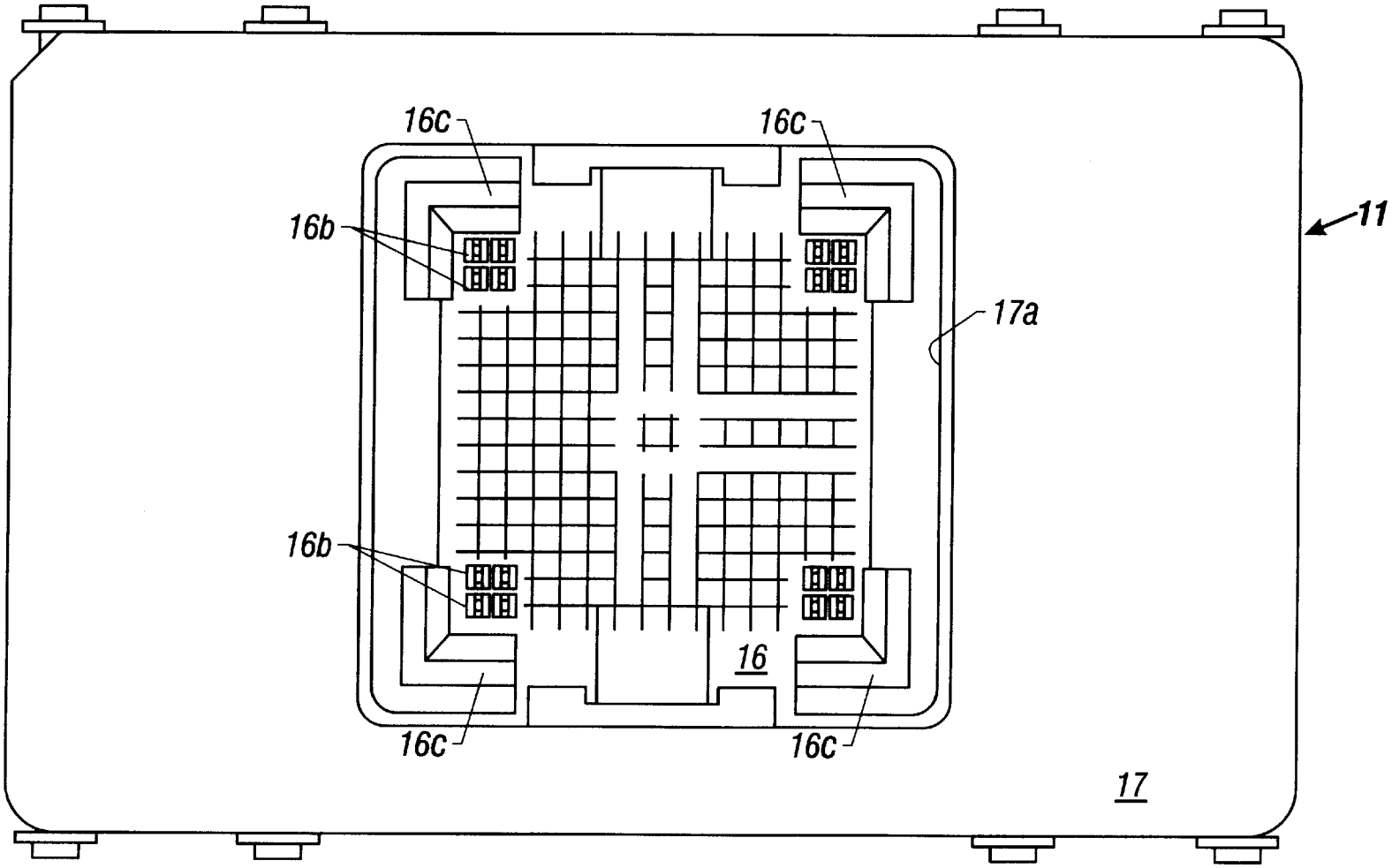
FIG. 4 is a plan view of an IC socket of the first embodiment 1.
Figure 5:
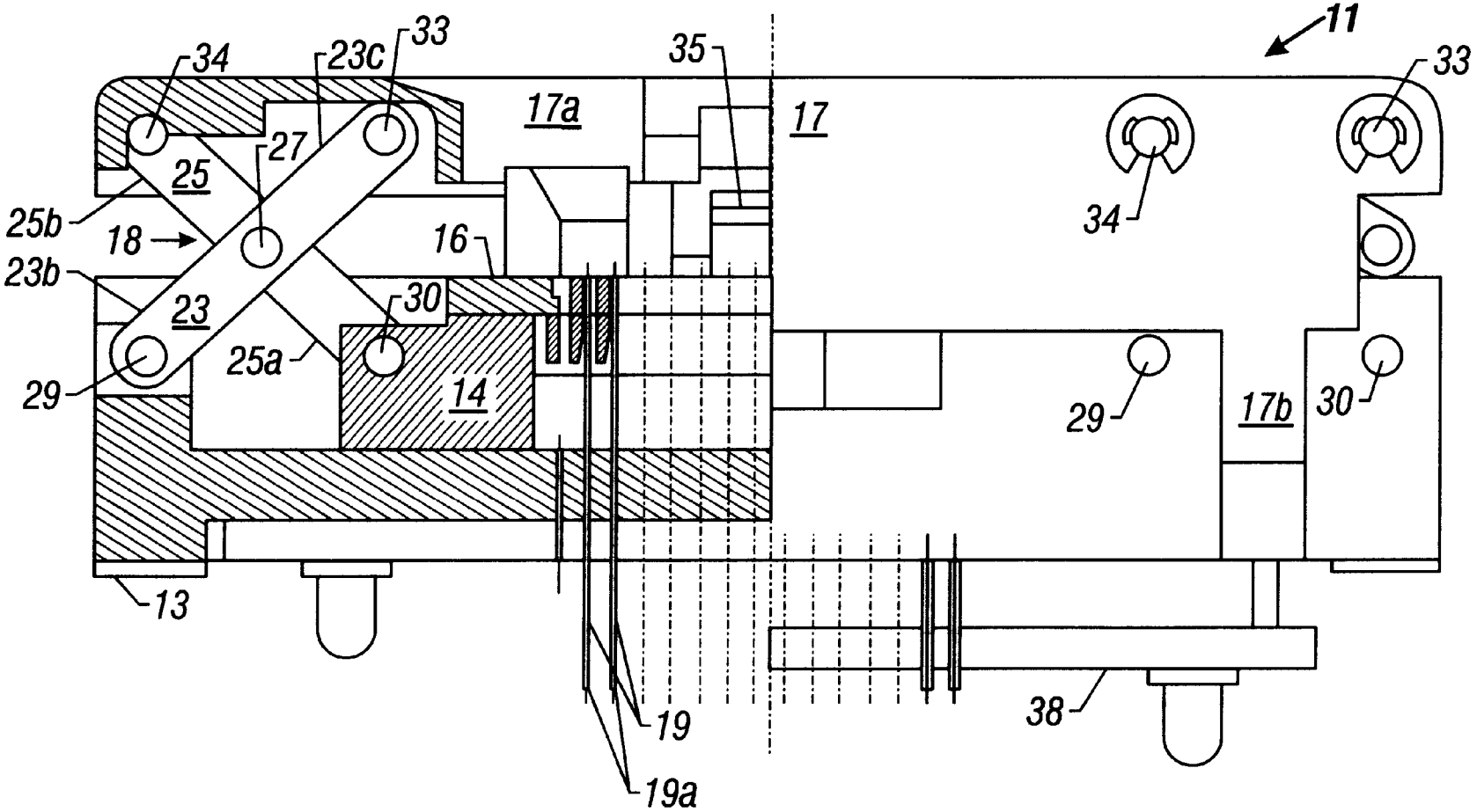
FIG. 5 is a front view, half in section, of the IC socket of the first embodiment 1.
Figure 6:
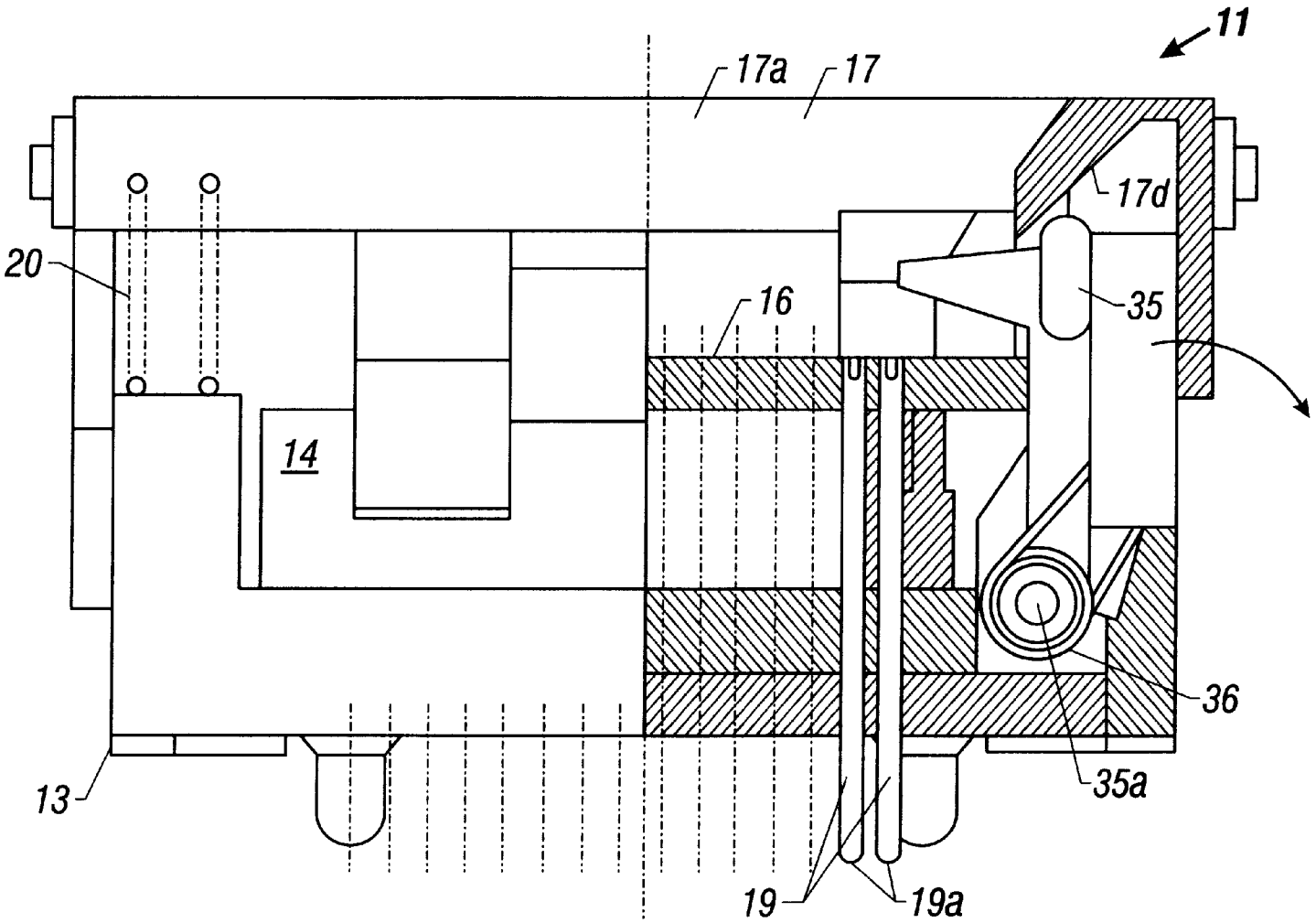
FIG. 6 is a right side view as sectional view of FIG. 5 concerning the first embodiment 1.
Figure 7C:
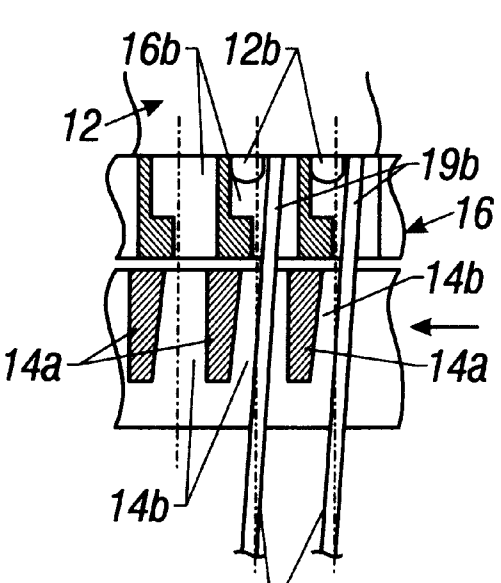
FIGS. 7*a* through 7*c* are sectional views showing a relationship between a movable plate and the contact pin according to the first embodiment 1.
Figure 7B:
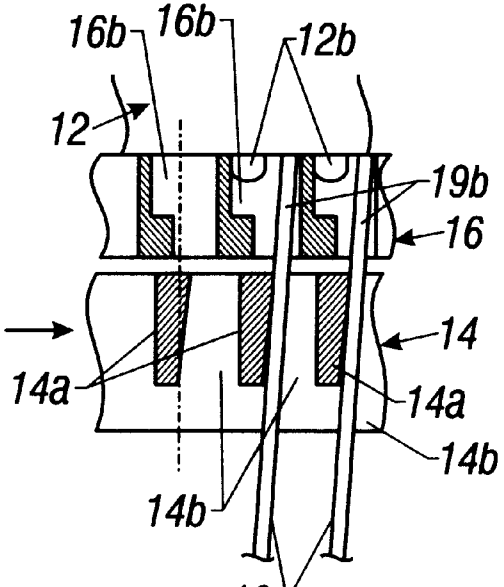
Figure 7A:
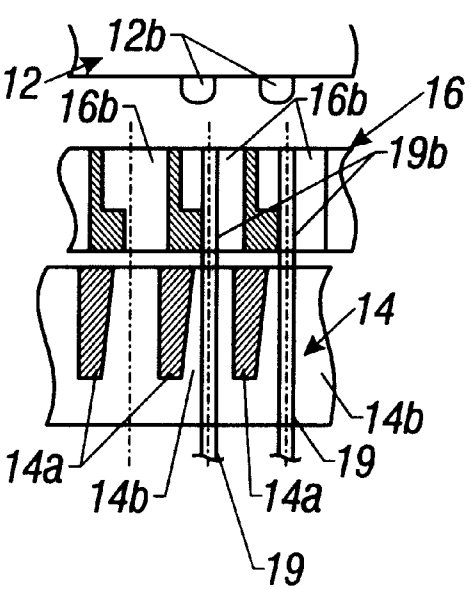

The structure of the first exemplary embodiment 1 will be first described hereunder with reference to FIGS. 4, 5 and 6, in which reference numeral 11 denotes an IC socket as an "electric connector" and the IC socket 11 serves to establish an electrical connection, for carrying out a performance test of an IC package 12 as an "electric part", between a solder ball 12*b* as "spherical terminal" of the IC package 12 and a printed wiring board, not shown, of a tester.

The IC socket 11 generally comprises a socket body 13 as a "connector body" to be mounted on the printed wiring board. A rectangular movable plate 14 is disposed on the socket body 13 to be horizontally movable in a predetermined direction, and a contact pin 19 provided for the socket body 13 is made elastically deformable through the horizontal movement of the movable plate 14. An upper plate 16 is disposed in a fixed state to the socket body 13 on the upper side of the movable plate 14, and further on the upper side thereof, an upper operation member 17 having a rectangular frame structure is disposed to be vertically movable in a manner such that when the upper operation member 17 is vertically moved, the movable plate 14 is horizontally moved through an X-shaped link 18.

Figure 1A:
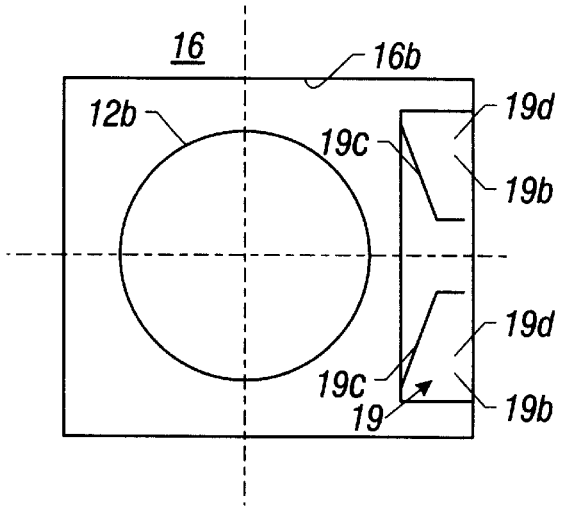
FIG. 1 represents a contact pin and solder ball according to a first embodiment 1 of the present invention, in which FIG. 1(*a*) is a plan view and FIG. 1(*b*) is a sectional view.
Figure 1B:
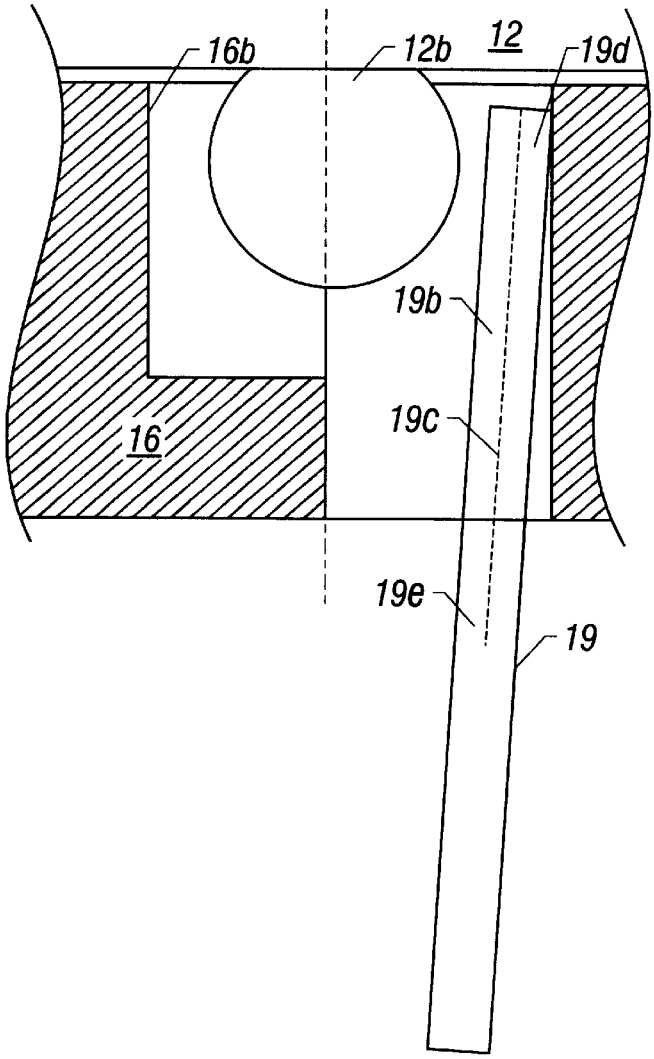
Figure 2:
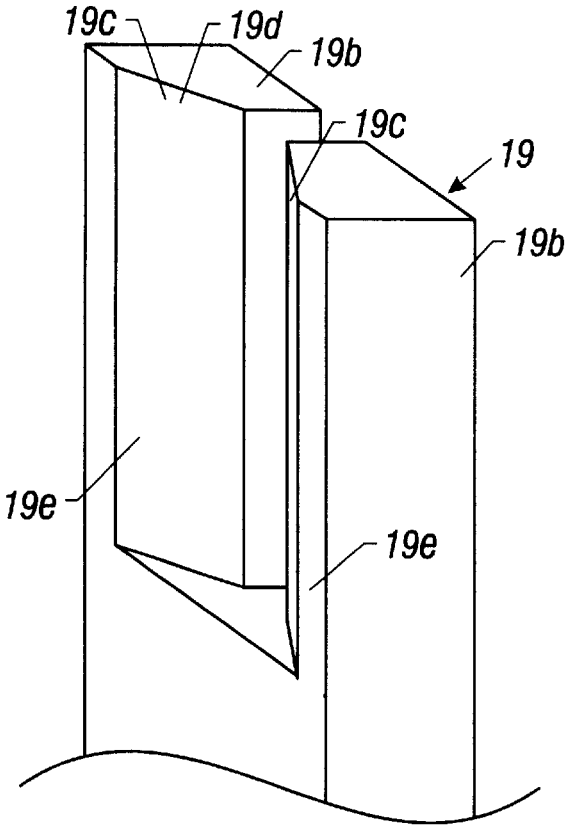
FIG. 2 is a perspective view of an upper portion side of the contact pin of the first embodiment 1.
Figure 3:
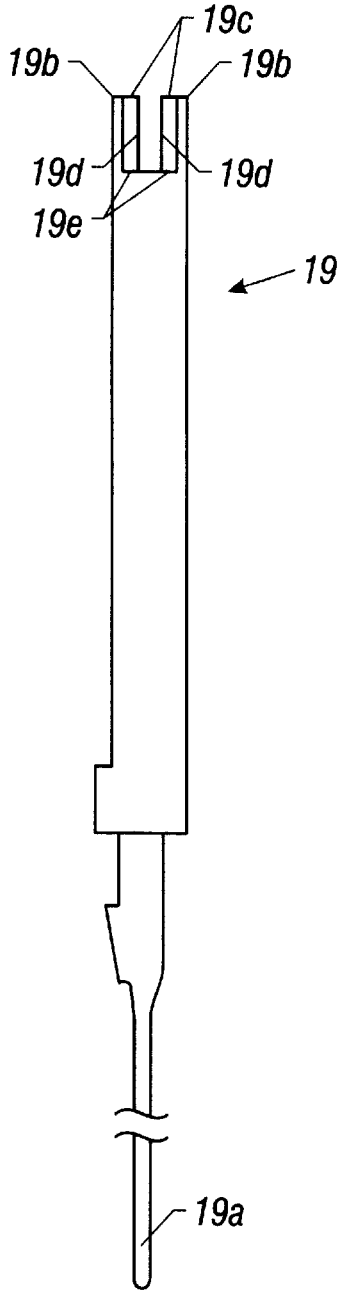
FIG. 3 is a front view of the contact pin of the first embodiment 1.

In more detail, the contact pin 19 is formed of a material having a springy property and excellent electric conductivity so as to provide an elongated plate shape, and as shown in FIGS. 5 and 6, the contact pin 19 is press fitted into the socket body 13. A lead portion 19*a* projects from the lower surface of the socket body 13 and is electrically connected to the printed wiring board. Furthermore, an upper side portion (tip end side portion) of the contact pin 19 projecting over the upper surface of the socket body 13 is inserted into an insertion portion 14*b* of the movable plate 14 and a through hole 16*b* formed to the upper plate 16. The tip end side portion of the contact pin 19 has a thinner central portion than both side edge portions in its width direction, as shown in FIGS. 1 and 2, so as to provide a fork-shape having branched pieces 19*b*, 19*b* having inclining surfaces 19*c*, 19*c*, respectively. These inclining surfaces 19*c*, 19*c* have tangential lines at contact points to the solder ball 12*b* directing to the center thereof. When the movable plate 14 is horizontally moved in an arrowed direction from the state shown by FIG. 7(*a*) to the state shown by FIG. 7(*b*), the contact pin 19 is pressed by a pressing portion 14*a* of the movable plate 14 and then elastically deformed, whereby the solder ball 12*b* in the IC package 12 is made insertional into the through hole 16*b* of the upper plate 16. Thereafter, when the movable plate 16 is returned in an arrowed direction in FIG. 7(*c*), the contact pin 19 contacts the solder ball 12*b* of the IC package 12 to thereby establish the electrical connection.

Furthermore, the upper plate 16 has a rectangular shape and is disposed on the upper side of the movable plate 14 in a state that a plurality of positioning bosses, not shown, projecting from the socket body 13 are fitted to recessed portions formed at corner portions of the rectangular upper plate 16. The movable plate 14 is provided with idle insertion portions into which the positioning bosses are idly inserted so that the idle insertion portions each has a size allowing the movable plate 14 to horizontally move without interfering the positioning boss when moved horizontally. The upper plate 16 is provided with a plurality of through holes 16*b*, each having a rectangular shape, into which the solder ball 12*b* of the IC package 12 is inserted, at portions corresponding to the insertion portions 14*b* formed to the movable plate 14 and also provided with four guide portions 16*c* for positioning the IC package 12 at the mounting time thereof at portions corresponding to four corner portions of the IC package 12, respectively.

The upper operation member 17 has a rectangular frame structure, as shown in FIG. 4, having an opening 17*a* of a size enabling the IC package 12 to be inserted therein, and the IC package 12 is inserted through the opening 17*a* and mounted on the upper plate 16. Further, the upper operation member 17 is disposed to the socket body 13 to be vertically movable through a slide portion 17*b*. As shown in FIG. 6, the upper operation member 17 is urged upward by means of spring 20 disposed between the upper operation member 17 and the socket body 13.

The X-shaped link 18 mentioned before is disposed to each of both end portions in the moving direction of both side surfaces along the moving direction of the rectangular movable plate 14. That is, in this embodiment, four X-shaped links 18 are disposed corresponding to both the end portions of both the side surfaces of the movable plate 14 to thereby constitute a toggle joint structure.

More concretely, each of the X-shaped links 18 is composed of first and second link members 23 and 25 both having the same length and connected with each other to be rotatable through a central connection pin 27.

The first link member 23 has a lower end portion 23*b* which is connected to the socket body 13 to be rotatable through a lower end connection pin 29, while the second link member 25 has a lower end portion 25*b* which is connected to one end portion of the side surface of the movable member 14 along the moving direction thereof to be rotatable through a lower end connection pin 30. These first and second link members 23 and 25 have upper end portions 23*c* and 25*c* which are connected to the upper operation member 17 through upper end connection pins 33 and 34 respectively to be rotatable. The upper end connection pin 33 provided for the upper end portion 23*c* of the first link member 23 is inserted into a slit 17*c* elongated in the horizontal direction formed to the upper operation member 17 to be movable in the horizontal direction.

Figure 8A:
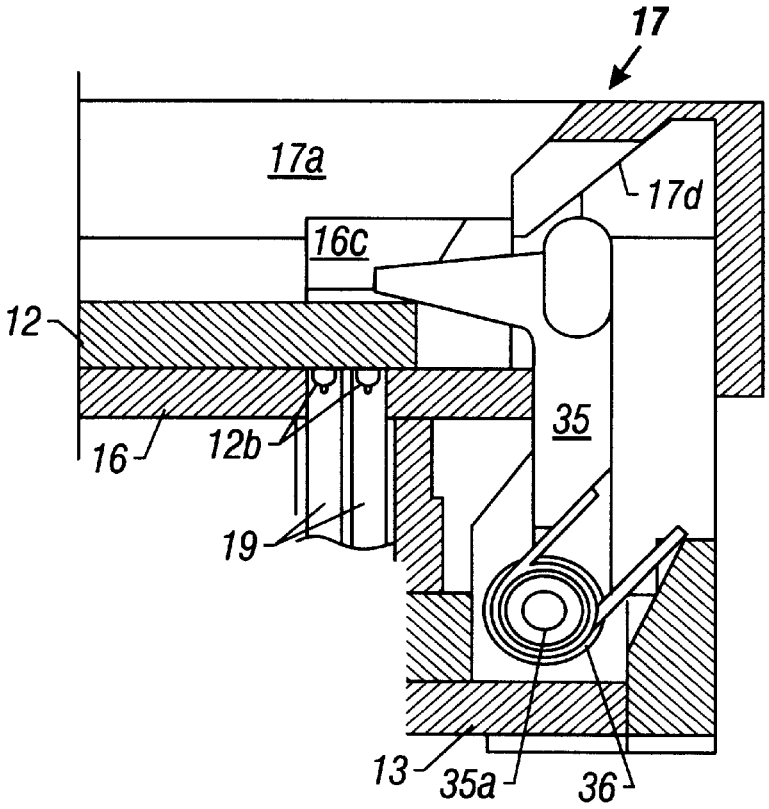
FIG. 8 represents a latch and the like and the contact pin concerning the first embodiment 1, in which FIG. 8(*a*) is a view showing a state of supporting the IC package and FIG. 8(*b*) is a view showing a state of the IC package released.
Figure 8B:
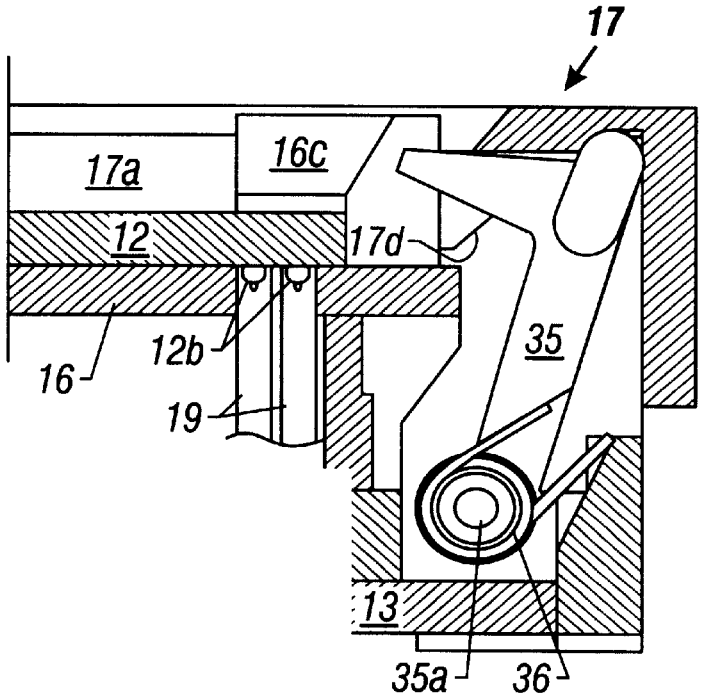

Further, as shown in FIGS. 6 and 8, a latch 35 is disposed to the socket body 13 to be rotatable about a shaft 35*a* disposed at the lower end portion of the latch 35 so as to be engageable with a side edge portion of the IC package 12 set to the predetermined position and the shaft 35*a* is urged by the spring 36 in an engaging direction. The upper operation member 17 is formed with a cam portion 17*d* sliding along the latch 35 at the lowering time thereof and rotating it in a disengaging direction.

In FIG. 5, reference numeral 38 denotes a location board performing a positioning function at the time of mounting to the printed wiring board.

The IC socket 11 of the structure mentioned above is used in the following manner.

A plurality of IC sockets 11 are preliminarily disposed on the printed wiring board by inserting the lead portions 19*a* of the contact pins 19 of the IC sockets 11 through the insertion holes of the printed wiring board and the inserted ends are then soldered.

The IC package 12 is set in the IC socket 11 by, for example, an automatic machine and then electrically connected thereto in the following manner.

That is, in a state of holding the IC package 12 by the automatic machine, the upper operation member 17 is pressed downward to lower the same against the urging force of the spring 20. Then, as shown in FIG. 8(*b*), the latch 35 is rotated against the urging force of the spring 36 by the cam portion 17*d* of the upper operation member 17 and the latch 35 is retired from the insertion range of the IC package 12. At the same time, the movable plate 14 is horizontally moved by the operation of the X-shaped links 18, and through this horizontal movement, the contact pin 19 is pressed by the pressing portion 14*a* formed to the movable member 14 and elastically deformed (see FIG. 7(*b*)). In this state, the solder ball 12*b* of the IC package 12 which has been held is inserted into the through hole 16*b* of the upper plate 16 to thereby release the IC package 12 from the automatic machine.

Thereafter, when the pressing force of the upper operation member 17 by means of the automatic machine is released, the upper operation member 17 is moved upward by the urging force of the spring 20 and the movable plate 14 is then returned to its original position. Through such operation, the contact pin 19 is returned by its elastic property and a pair of inclining surfaces 19*c*, 19*c* at the upper end portion of the contact pin 19 are electrically contacted and then connected to the solder ball 12*b* of the IC package 12.

Figure 10A:
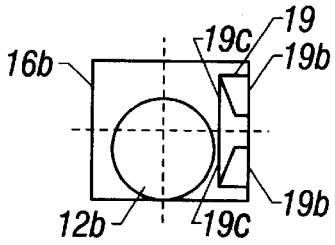
FIGS. 10*a* through 10C are plan views explaining an operation of the contact pin and the solder ball according to the first embodiment 1.
Figure 10B:
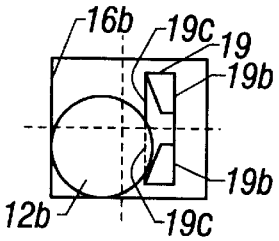
Figure 10C:
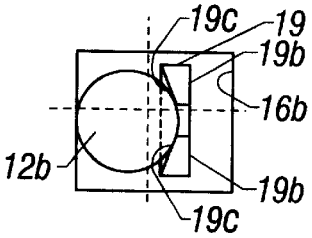
Figure 11A:
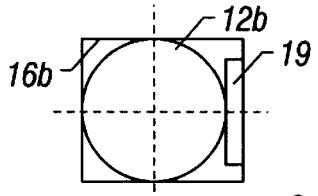
FIGS. 11*a* and 11*b* are plan views showing the contact pin and the solder ball according to the first embodiment 1.
Figure 11B:
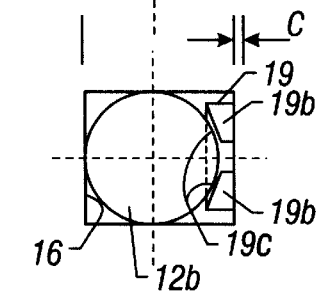

More in detail, under the state that the solder ball 12*b* is inserted into the through hole 16*b* of the upper plate 16, in a case shown in FIG. 10(*a*) in which the solder ball 12*b* is shifted from the center of the through hole 16*b*, the inclining surface 19*c* of one of the branched pieces 19*b* of the contact pin 19 abuts against the side surface of the solder ball 12*b* by returning the contact pin 19 (see FIG. 10(*b*)), whereby the solder ball 12*b* moves along the inclining surface 19*c*, thereby contacting the other inclining surface 19*c*, and hence, the solder ball 12*b* abuts against both the inclining surfaces 19*c*, 19*c* with equal force, thereby establishing the electrically conductive state. In such manner, the solder ball 12*b* is positioned to the predetermined position (see FIG. 10(*c*)). Further, through such sliding motion of the solder ball 12*b* along the inclining surfaces 19*c*, 19*c*, a wiping function will be achieved.

Figure 12A:
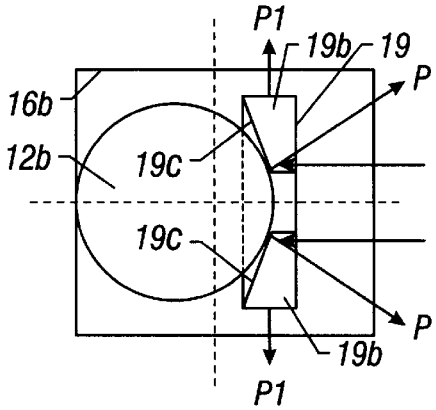
FIG. 12 is a view showing the contact pin and the solder ball according to the first embodiment 1, in which FIG. 12(*a*) is a plan view and FIG. 12(*b*) is a sectional view.
Figure 12B:
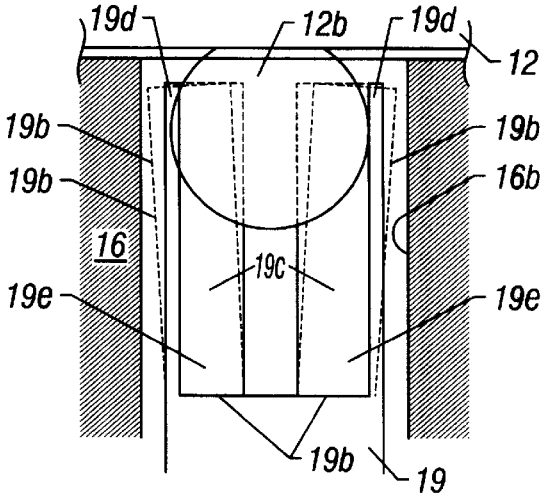
Figure 13:
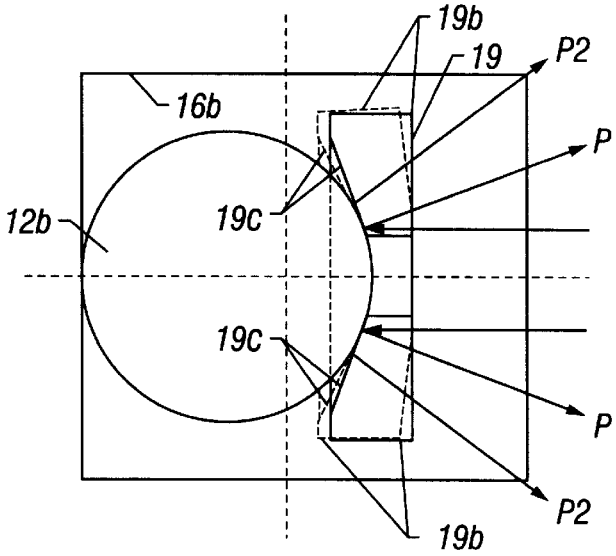
FIG. 13 is a plan view explaining an operation of the contact pin and the solder ball according to the first embodiment 1.

Under the state mentioned above, when the solder ball 12*b* is further pressed, a reaction force P due to the solder ball 12*b* acts in a direction perpendicular to the inclining surfaces 19*c*, 19*c* as shown in FIG. 12(*a*). In this moment, the branched pieces 19*b*, 19*b* of the fork-shaped contact pin 19 are flexed outward as shown with dash and two-dot-line in FIG. 12(*b*) by a component force P1 of the reaction force P. Accordingly, the solder ball 12*b* slides along the inclining surfaces 19*c*, 19*c* to thereby achieve the wiping function. Furthermore, twisting moment is caused to the respective branched pieces 19*b*, 19*b* by the reaction force P as shown in FIG. 13 and the branched pieces are twisted as shown with dash and two-dot-line in FIG. 12(*b*). According to such twisting motion, the angles of the inclining surfaces 19*c*, 19*c* vary and the direction of the reaction force P also varies to P2, and as a result, the component force P2 is increased and accordingly the flexibility of the branched pieces 19*b*, 19*b* are also made large. As a result, the wiping function can be further improved.

At the same time, the upper operation member 17 is moved upward and the latch 35 is rotated in a direction reverse to the arrowed direction in FIG. 6 by the urging force of the spring 36 and engaged with the side portion of the IC package 12, thus holding the IC package 12 (see FIG. 8(*a*)).

The X-shaped links 18 for horizontally moving the movable plate 14 is explained hereunder.

Figure 9A:
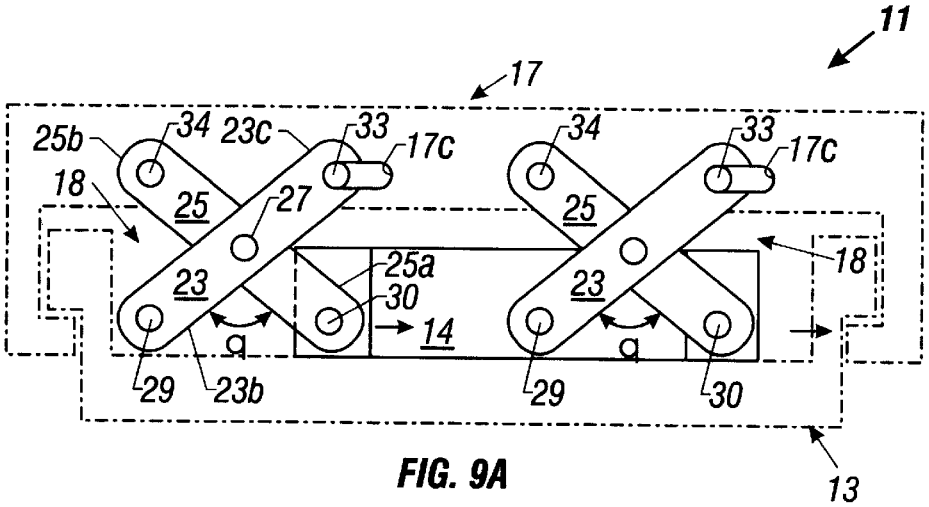
FIG. 9 is a schematic view showing a link mechanism of the IC package according to the first embodiment 1, in which FIG. 9(*a*) is a view showing a state before the lowering of an upper operation member and FIG. 9(*b*) is a view showing a state after the upper operation member is lowered.
Figure 9B:
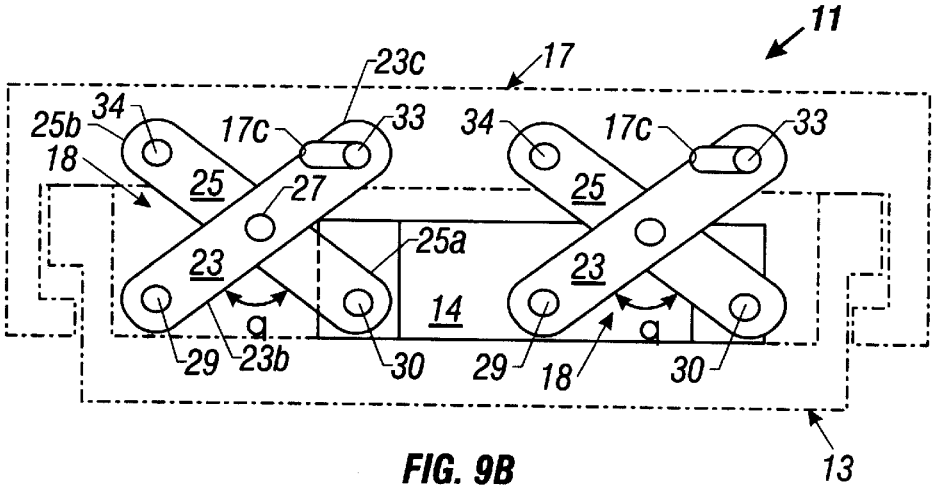

When the upper operation member 17 is lowered, the upper end portions 23*c* and 25*c* of the respective link members 23 and 25 are pressed downward and then lowered from the state shown in FIG. 9(*a*) to the state shown in FIG. 9(*b*), and then, the respective link members 23 and 25 are rotated to thereby horizontally move (in an arrowed direction) the lower end portion of the second link member 25 and hence horizontally move the movable plate 14 in the arrowed direction.

As mentioned hereinbefore, the central portion side of the contact pin 19 is made thinner than both the side edge portions in the width direction thereof to thereby form the inclining surfaces 19*c*, so that the spherical solder ball 12*b* enters this thinner portion. Accordingly, the case shown in FIG. 11(*b*), in comparison with a case shown in FIG. 11(*a*), in which any improvement is not applied to the contact pin 19 having a flat surface, the through hole 16*b* of the upper plate 16 can be made small by an amount corresponding to a size C. That is, it is necessary for the through hole 16*b* of the upper plate 16 to have a size capable of receiving a solder ball 12*b* having the maximum radius and the contact pin 19 so that various solder balls 12*b* having various sizes can be inserted into the through hole 16*b*. However, in a case where a plurality of solder balls 12*b* support the IC packages 12 arranged with a fine interval therebetween, it is required to make large a rib-distance between the through holes 16*b* in the viewpoint of strength, and accordingly, it is necessary to make the size of the through hole 16*b* as possible as small. In this viewpoint, it is extremely effective to make small the through hole 16*b* by the size C as mentioned above.

In the embodiment described above, the solder ball 12*b* can be prevented from disengaged upward with the solder ball 12*b* being held by the inclining surface 19*c* of the contact pin 19 and the peripheral edge portion of the through hole 16*b* by forming a recessed portion, having a size capable of receiving a portion of the solder ball 12*b*, to a portion of the inclining surface 19*c* of the contact pin 19 contacting the solder ball 12*b* or a portion of the peripheral edge portion of the through hole 16*b* abutting against the solder ball 12*b*, whereby the IC package 12 can be surely held. This mode will be applicable to the following embodiments.

[Exemplary Embodiment 2]

Figure 14A:
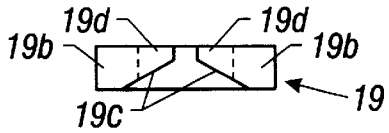
FIG. 14 is a view showing a contact pin according to a second embodiment 2, in which FIG. 14(*a*) is a plan view and FIG. 14(*b*) is a front view.
Figure 14B:
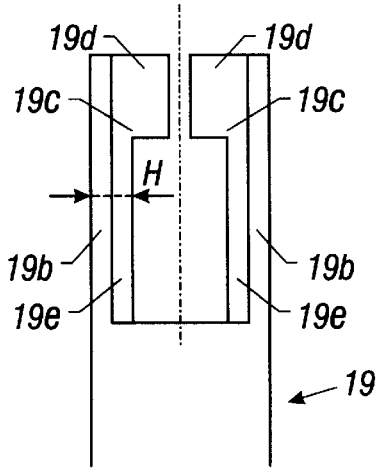

FIG. 14 represents a second exemplary embodiment 2 of the present invention.

In this embodiment 2, the two-fork shaped branched pieces 19*b* each has a root portion 19*e* having a width H smaller than that of a contact side portion 19*d* thereof.

According to this structure, since the sectional secondary moment of the root portion 19*e* of each of the branched pieces 19*b* is made small, when a reaction force is applied to the contact side portion 19*d* from the solder ball side, the twisted and flexed amounts of the branched piece 19*b* is made large in comparison with the case of the embodiment 1. Accordingly, the wiping effects can be improved.

The other structures and functions of the embodiment 2 are substantially the same as those of the embodiment 1.

[Exemplary Embodiment 3]

Figure 15A:
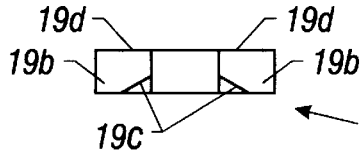
FIG. 15 is a view showing a contact pin according to a third embodiment 3, in which FIG. 15(*a*) is a plan view and FIG. 15(*b*) is a front view.
Figure 15B:
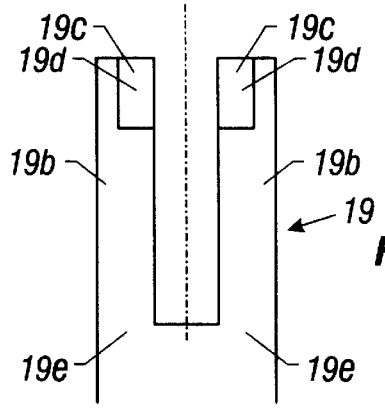

FIG. 15 represents a third exemplary embodiment 3 of the present invention.

In the embodiment 3, only the front end portion (contact side portion 19*d*) of each of the two-fork shaped branched pieces 19*b* is formed with the inclining surface 19*c*.

According to this structure, since the branched piece 19*b* provides as a whole a large sectional secondary moment, the twisted and flexed amounts of the branched piece 19*b* can be made small in comparison with the embodiment 1, so that it is effective to make large the contact pressure between the solder ball 12*b* and the contact pin 19.

The other structures and functions of the embodiment 3 are substantially the same as those of the embodiment 1.

[Exemplary Embodiment 4]

Figure 16A:
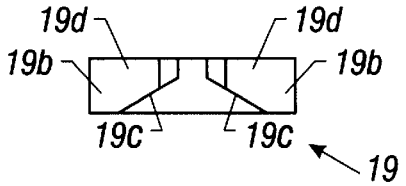
FIG. 16 is a view showing a contact pin according to a fourth embodiment 4, in which FIG. 16(*a*) is a plan view and FIG. 16(*b*) is a front view.
Figure 16B:
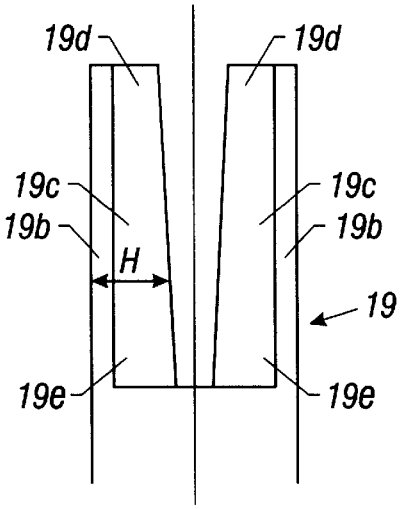

FIG. 16 represents a fourth exemplary embodiment 4 of the present invention.

In this embodiment 4, each of the two-fork shaped branched pieces 19*b* is formed such that the width H thereof is made gradually narrow towards the front end portion from the root portion 19*e* thereof and the inclining surface 19*c* is formed from the root portion 19*e* to the front end portion.

According to this structure, since the sectional secondary moment of the branched piece 19*b* is gradually changed, the stress distribution of each of the branched pieces 19*b* can be made substantially equal at the respective positions and the concentration of the stress can be prevented.

The other structures and functions of the embodiment 4 are substantially the same as those of the embodiment 1.

[Exemplary Embodiment 5]

Figure 17A:
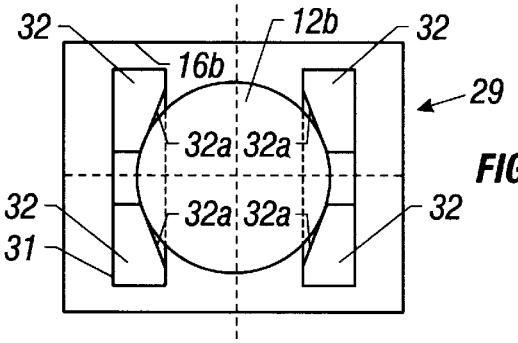
FIG. 17 is a view showing the contact pin and a solder ball according to the fourth embodiment 4, in which FIG. 17(*a*) is a plan view and FIG. 17(*b*) is a front view.
Figure 18:
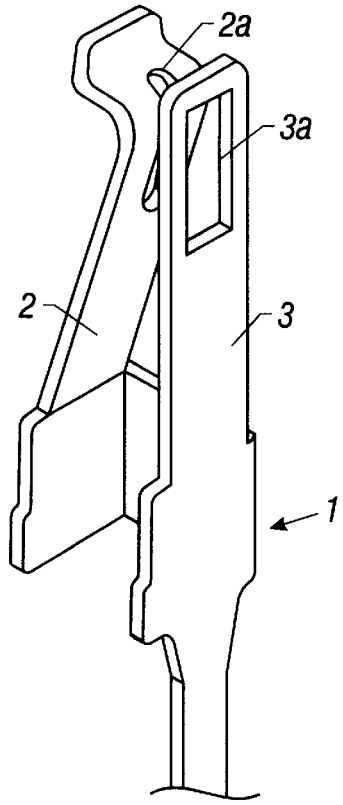
FIG. 18 (Prior Art)
FIG. 18 is a perspective view showing a conventional contact.
Figure 17B:
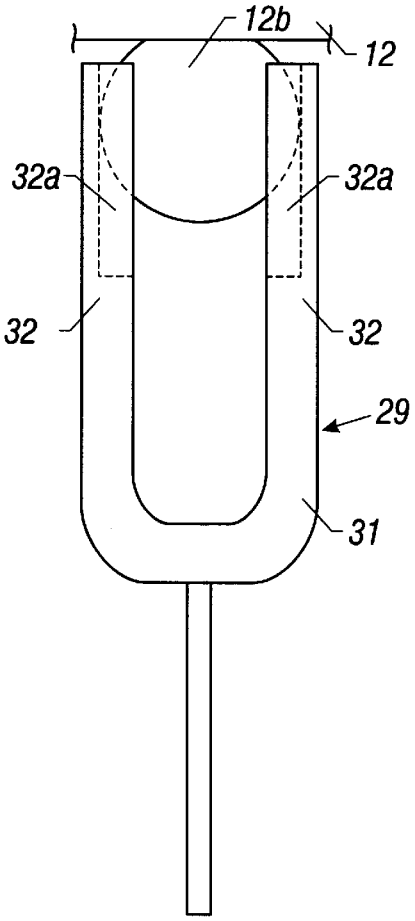
Figure 19:
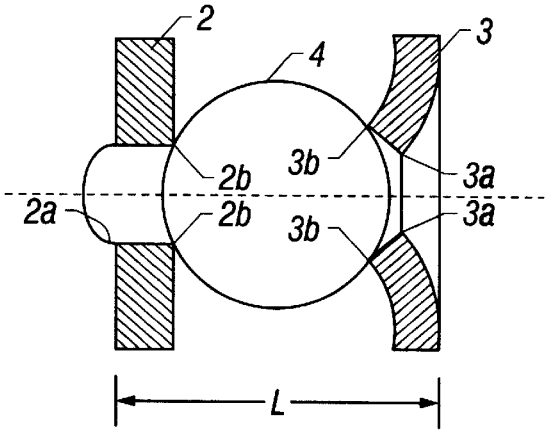
FIG. 19 (Prior Art)
FIG. 19 is a sectional view of the conventional contact.

FIG. 17 represents a fifth exemplary embodiment 5 of the present invention.

A contact pin 29 of this embodiment 5 is formed with a U-shaped portion 31 at its upper side portion and each leg portions of this U-shaped portion 31 are each formed to provide two-fork shape, thus providing totally four branched pieces 32. These branched pieces 32 are each formed with an inclining surface 32*a* as in the embodiment 1.

In the structure of this embodiment 5, the solder ball 12*b* is inserted into the fork shape portions of the U-shaped portion 31, which is hence widened through an elastical deformation, whereby the solder ball 12*b* contacts the respective inclining surfaces 32*c*.

In the respective exemplary embodiments mentioned above, although the "contact pin" of the present invention is applied to the contact pin 19 of the IC socket 11, the contact pin is not limited to it and may be applicable to contact pins of other devices, and furthermore, although the contact pin is applied to the IC socket 11 as "electric connector", it may be applicable to other devices which achieve the function of an electrical connection.

Furthermore, in the above exemplary embodiments, although the contact pin is formed so as to provide the two-fork shape, the present invention is not limited to this shape and may take a structure such that the central side portion of the contact portion is formed thinner in the width direction in comparison with both the side edge portions and at least two inclining surfaces contacting to and separating from the spherical terminal are formed so that both the tangential lines at the points contacting the spherical terminal are directed to the central portion thereof. In this structure, the two inclining surfaces will provide a continuous "<" shape. Further, the inclining surface may be formed to provide a flat surface or curved surface.

Possibility of Industrial Usage

As mentioned above, the contact pin according to the present invention can be preferably applied to a contact pin of an IC socket. It is of course applicable to contact pins of other devices. Furthermore, the electric connector according to the present invention can be preferably used as an IC socket into which IC packages can be detachably mounted, which is of course applicable to other devices which attain the function of the electrical connection.

What is claimed is:

1. A contact pin adapted to contact a side surface of a spherical terminal of an electric part, comprising:

two contacting portions, each having an edge portion, said edge portion having a thickness;

a central portion between the two contacting portions, said thickness of the central portion being less than said thickness of each of the edge portions; and each of said contacting portions comprising an inclined surface adapted to contact a side surface of the spherical terminal, and wherein, while the two inclined surfaces of the two contacting portions of the contact pin are contacted to the side surface of the spherical terminal so that current flows through the contacting portions of the contact pin into the spherical terminal of the electric part, normal lines at contact points at which the inclined surfaces and the side surface of the spherical terminal are contacted are directed to a center of the spherical terminal.

2. The contact pin according to claim 1, wherein each of said contacting portions has a front end portion and each of said inclined surfaces is formed only on the front end portion of the corresponding contacting portion.

3. The contact pin according to claim 1, wherein each of said contacting portions has a front end portion, and the front end portions are formed so as to provide two-fork shaped branched pieces, to which the inclined surfaces are formed respectively.

4. The contact pin according to claim 3, wherein each of said branched pieces is provided at its one end side with a contact portion and its other end side with a root portion, each of said contact portions being adapted to contact the side surface of the spherical terminal and having a width, said root portion having a width which is narrower than the width of the corresponding contact portion.

5. The contact pin according to claim 3, wherein each of said branched pieces has a width and is provided at its one end side with a contact portion and its other end side with a root portion, said contact portion being adapted to contact the side surface of the spherical terminal, said width gradually reducing from the root portion towards the contact portion, said each of the inclined surfaces being formed to extend from the root portion to the contact portion.

6. An electric connector for an electrical part having a spherical terminal, said electric connector comprising:

a connector body;

a contact pin disposed on the connector body and formed as a long plate shape, said contact pin having two contacting portions for contacting the spherical terminal, each of said contacting portions having a front end portion formed so as to provide two-fork shaped branched pieces;

a central portion between the two contacting portions, said central portion having a thickness;

a movable plate disposed in the connector body to be horizontally movable, said movable plate being horizontally moved so as to elastically deform the contact pin;

an upper operation member disposed on an upper portion of the connector body to be vertically movable; and a link mechanism operatively connected to the movable plate and the upper operation member, wherein, when the upper operation member is moved downward, said movable plate is horizontally moved through the link mechanism thereby elastically deforming the contact pin and displacing the contact pin so that the spherical terminal of the electric part is inserted in the connector body while the spherical terminal is not pressed to fit to the contact pin, and when the upper operation member is moved upward, said movable plate is returned to an original portion and the contact pin is released from an elastically deformation force of the movable plate so that the contacting portion of the contact pin is contacted to a side surface of the spherical terminal to establish an electrical connection, each of said contacting portions of the contact pin comprising:

an edge portion having a thickness, said thickness of the central portion being less than said thickness of each of the edge portions; and an inclined surface adapted to contact the side surface of the spherical terminal wherein, while the two inclining surfaces of the contact portions are contacted to the side surface of the spherical terminal so that current flows through the contacting portions of the contact pin into the spherical terminal of the electric part, normal lines at the contact points at which the inclines surfaces and the side surface of the spherical terminal are contacted are directed to a center of the spherical terminal.

7. A contact pin adapted to contact a side surface of a spherical terminal of an electric part, comprising:

two contacting portions, each having an edge portion, said edge portion having a thickness;

a central portion between the two contacting portions, said thickness of the central portion being less than said thickness of each of the edge portions; and each of said contacting portions comprising an inclined surface adapted to contact a side surface of the spherical terminal and to be separated from the side surface thereof, and wherein, while the two inclined surfaces of the contact pin are contacted to the side surface of the spherical terminal so that current flows through the contacting portion of the contact pin into the spherical terminal of the electric part, the two inclined surfaces are directed to a center of the spherical terminal and extending lines inwardly extending along the respective inclined surfaces of the two contacting portions of the contact pin are crossed to each other.

8. The contact pin according to claim 7, wherein each of said contacting portions has a front end portion and each of said inclined surfaces is formed only on the front end portion of the corresponding contacting portion.

* * * * *

UNITED STATES PATENT AND TRADEMARK OFFICE

CERTIFICATE OF CORRECTION

PATENT NO. : 6,139,348
DATED : October 31, 2000
INVENTOR(S) : Masami Fukunaga

It is certified that error appears in the above-identified patent and that said Letters Patent is hereby corrected as shown below:

Title page,
After the title please insert the following, "This application is a continuation of application Serial No. PCT/JP97/03764, filed October 17, 1997".

Signed and Sealed this

Eleventh Day of December, 2001

*Attest:*

Nicholas P. Godici

*Attesting Officer*

NICHOLAS P. GODICI
*Acting Director of the United States Patent and Trademark Office*